US008879367B2

(12) United States Patent
Breckman

(10) Patent No.: US 8,879,367 B2
(45) Date of Patent: Nov. 4, 2014

(54) SYNCHRONIZED WATCHES THAT WORK IN TANDEM TO TELL TIME

(71) Applicant: Andrew Breckman, Madison, NJ (US)

(72) Inventor: Andrew Breckman, Madison, NJ (US)

( * ) Notice: Subject to any disclaimer, the term of this patent is extended or adjusted under 35 U.S.C. 154(b) by 0 days.

(21) Appl. No.: 14/047,066

(22) Filed: Oct. 7, 2013

(65) Prior Publication Data

US 2014/0098648 A1 Apr. 10, 2014

Related U.S. Application Data

(60) Provisional application No. 61/711,004, filed on Oct. 8, 2012.

(51) Int. Cl.
*G04B 19/04* (2006.01)
*G04B 45/00* (2006.01)

(52) U.S. Cl.
CPC ..... *G04B 45/00* (2013.01)
USPC ..... 368/228

(58) Field of Classification Search
CPC ..... G04B 45/00; G04B 19/04; G04B 19/06; G04B 19/082; G04B 45/0092
USPC ..... 368/228
See application file for complete search history.

(56) References Cited

U.S. PATENT DOCUMENTS 1,784,195 A 12/1930 Morris
2,801,779 A * 8/1957 Jenkins ..... 224/165
2,852,908 A 9/1958 Stern et al.
3,364,599 A 1/1968 Polsky
3,908,355 A 9/1975 Wiesner
5,030,104 A 7/1991 Caldwell
5,257,246 A * 10/1993 Ehsman ..... 368/282
5,505,624 A 4/1996 Novosel
6,322,245 B1 * 11/2001 Cooper ..... 368/276
6,406,301 B2 6/2002 Richards
6,421,302 B1 * 7/2002 Wimberly ..... 368/223
6,903,784 B1 6/2005 Basturk

OTHER PUBLICATIONS

Watchismo Time Machine, Single Hand Watches, One Hand Watches from Watchismo.com, http://www.watchismo.com/one-hand-watches.aspx.

* cited by examiner

*Primary Examiner* — Edwin A. Leon
(74) *Attorney, Agent, or Firm* — Gearhart Law, LLC

(57) ABSTRACT

The current disclosure describes and teaches a timepiece combination that may preferably be used by a pair of persons to show unity, affection, and togetherness. In one embodiment, the timepiece combination may include two watches having similar or complimentary background pattern and overall design, while one watch displays only the hourly time of the present time, the other watch displays only the minute time of the present time. Only by combining the display of the watches may the users be shown the precise present time. The timepiece combination may take the conventional clock hand format or a digital display. Overall, the design of the timepiece combination emphasizes and reflects the bond and unity between the users, allowing a showing of friendship, love, and/or affection through the watches.

19 Claims, 2 Drawing Sheets

SYNCHRONIZED WATCHES THAT WORK IN TANDEM TO TELL TIME

CLAIM OF PRIORITY

This application claims priority to U.S. Application Ser. No. 61/711,004 filed on Oct. 8, 2012, the contents of which are incorporated herein by reference in their entirety.

FIELD OF THE INVENTION

The current invention relates to combination of timepieces, such as watches. In particular, the current invention relates timepiece combinations wherein the timepieces have complimentary designs and the combination of such timepieces show an exact time.

BACKGROUND OF THE INVENTION

At this day and age, timepieces such as watches and clocks have become an indispensible part of most people's lives. The timepieces are everywhere and the take many possible forms and designs. In the most basic format, the analog timepieces use the conventional marked dial and hour-hand, minute-hand combination, with the possibility of a second hand. Alternatively, the digital timepieces display the numbers for the hour, minute, and possibly second in digital form. More importantly, timepieces have taken up roles other than showing the present time, though that remains the most basic fundamental function.

Besides showing time, timepieces such as watches and clocks may be used for aesthetic appeal, as indications for social status of the user/wearer, and/or as general fashion accessories. With proper choices, the timepieces, particularly watches, may demonstrate a wearer's profession, interest, emotion, and affiliations. However, the existing timepieces are not designed specifically as combinations or sets to show the feelings between individuals, particularly individuals having close relationships. The current invention introduces a timepiece combination that allows the wearers of the timepieces show their friendship, bond, love, unity, and/or affection through combined time display and general closeness. The design of the current invention is simple, elegant, and differs from all the previous disclosures.

DESCRIPTION OF RELATED ART

U.S. Pat. No. 6,406,301 discloses a teaching device adapted to teach the reading of an analogue clock face comprising first and second components one of which is transparent, one of said components being marked to represent a clock face displaying minutes and on which a minute clock hand can be manually rotated and the other of said components being marked to represent a clock face displaying hours and on which an hour clock hand can be manually rotated, and means for removably connecting said first and second components together with said minute and hour clock face superimposed one above the other to display a complete analogue clock face showing hours and minutes and having hour and minute hands.

U.S. Pat. No. 3,908,355 discloses an electronic watch having an electrochromic display in which the transparent electrode pattern of minute hands is formed on one plate of the display, while the pattern for the hour hands is formed on the other plate of the display. A counter electrode to the hour and minute hands is provided outside the field of vision. In this way realistic simulation of the passage of one hand over the other is obtained. A control logic system is provided for sequentially activating and setting the hands to a particular indication of time information.

These disclosures, however, do not serve the same function as the current invention. In addition, their structure and design are fundamentally different. In summary, various devices are known in the art, but they are distinctively different from the current invention. Moreover, the other inventions fail to address the issues solved by the invention described herein. A number of embodiments of this invention are illustrated in the accompanying drawings and will be described in more detail herein below.

SUMMARY OF THE INVENTION

The current invention discloses a timepiece combination comprising a first timepiece showing the hourly time of a present time; and a second time piece showing only the minute time of the present time; wherein combining the first timepiece and second timepiece displays a precise reading of the present time. The timepieces here may be any kind, such as but not limited to watches, clocks, vehicle time displays, and all other kinds of individualized or group time displaying mechanisms. The timepieces may be mechanical or electrical, or any combination of such. Here, "combining" the timepieces refers to the practice of viewing or showing the time displays on the individual timepieces at the same time or in immediate succession, preferably when the timepieces are in close proximity of each other. The display format of the timepiece may vary as well. It may be analog or digital, or any combination thereof.

For example, the analog timepiece may use a marked or numbered dial with conventional "clock hand" format with an hour hand and a minute hand. In particular, the timepiece combination may include a first watch having a first watch case enclosing a first watch face having a set of first time marks on a periphery of the first watch face, wherein the first watch only has an hour hand displaying the present time, and the second time piece is a second watch having a second watch case enclosing a second watch face having a set of second time marks on the periphery of the second watch face, wherein the second watch only has a minute hand displaying the minute time of the present time, and combining the first watch and second watch displays a precise reading of the present time. It should be noted that "hour hand only" analog watches are available. However, such watches suffer from the apparent difficulty of displaying precise time since the segment between two close time points is too small. In the current invention, it should be noted that the first watch is preferably an "hour hand only" watch in the conventional sense. In that case, the first watch is theoretically showing not only the hour time, but present time as a whole. Nevertheless, as indicated above, such display is far from precise and only the combination with the second watch allows an exact display of the present time.

Alternatively, the timepieces in the timepiece combination may take on a digital format. In particular, the timepiece combination may comprise a first watch having a first watch case enclosing a first watch face, wherein on the first watch face shows only an hour digit displaying the hour time of a present time; and a second watch having a second watch case enclosing a second watch face, wherein on the second watch face shows only a minute digit displaying the minute time of the present time, and combining the first watch and second watch displays a precise reading of the present time. Unlike the analog format, with the digital format, the first watch shows only the hour time, not any more, making it more essential to combine the two watches to get an exact reading.

The timepieces are preferably watches, including but not limited to wristwatches and pocket watches. The watches may have particular designs that are unrelated to the function of time display. For example, on the watch face, there may be a background pattern. The time marks may be Roman numbers, Arabic numbers, or simple markings. In addition, the watches may also include straps and crowns for both functional and appearance purposes. The overall appearance and the materials used constitute the general design of the watches and such designs for the pairing timepieces in the current invention are preferably the same, matching, or complimentary. These features allow the timepieces in the combination to have complimentary designs so further demonstrate the close relationship between the wearers of the timepiece combination.

As indicated above, the users of the timepiece combination may use the timepieces to show their mutual feelings and demonstrate the friendship, love, unity, bond, and/or affection to one another. While one user wears the first timepiece displaying the hour time, the other wears the second timepiece displaying the minute time. The users stay close to one another and show the precise reading of a present time by combining the reading of the first timepiece with that of the second timepiece.

In general, the present invention succeeds in conferring the following, and others not mentioned, desirable and useful benefits and objectives.

It is an object of the present invention to provide a timepiece combination that includes at least two pieces.

It is an object of the present invention to provide a timepiece combination that includes more than two timepieces.

It is an object of the present invention to provide a timepiece combination that has a first timepiece showing the hour time and another timepiece showing the minute time.

It is an object of the present invention to provide a timepiece combination that only start to show time after being triggered.

It is another object of the current invention to provide a timepiece combination that shows the mutual feelings between the users.

It is another object of the current invention to provide a timepiece combination that includes timepieces having same or complimentary designs.

It is still another object of the current invention to provide a timepiece combination that is portable and easy to carry around.

It is another object of the current invention to provide a timepiece combination that is inexpensive It is yet another object of the current invention to provide a timepiece combination in which each timepiece is capable of showing the precise time with the user choose to.

It is another object of the current invention to provide a timepiece combination that includes two timepieces with matching shapes and sizes.

It is yet another object of the current invention to provide a timepiece combination a first timepiece showing the hourly time of a present time; and a second time piece showing only the minute time of the present time; wherein combining the reading of the first timepiece and second timepiece displays a precise reading of the present time.

DESCRIPTION OF THE PREFERRED EMBODIMENTS

Figure 1A:
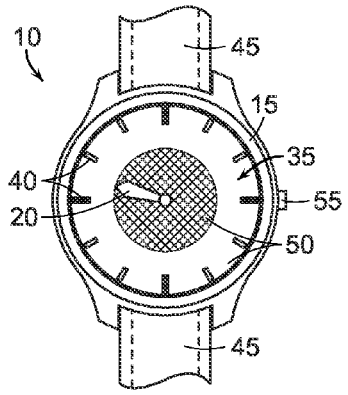
FIG. 1A and FIG. 1B show a front view of a timepiece combination having a first watch and a second watch in the analog format.

The preferred embodiments of the present invention will now be described with reference to the drawings. Identical elements in the various figures are identified, as far as possible, with the same reference numerals. Reference will now be made in detail to embodiments of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto without deviating from the innovative concepts of the invention.

Figure 1B:
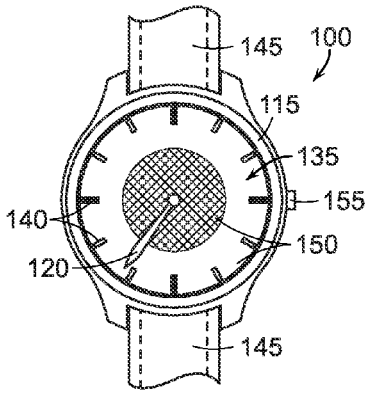

FIG. 1A and FIG. 1B show a front view of a timepiece combination having a first watch and a second watch with an analog format. Shown in FIG. 1A is the first watch 10 having a first watch case 15 enclosing a first watch face 35 having a set of first time marks 40 on the periphery of the first watch face 35. The first watch 10 also has two first straps 45, a first crown 55. The first watch face 35 has a first background pattern 50. In addition, the first watch 10 only has an hour hand 20 displaying a present time, particularly the hour time of the present time. Shown in FIG. 1B is the second watch 100 having a second watch case 115 enclosing a second watch face 135 having a set of second time marks 140 on the periphery of the second watch face 135. The second watch 100 also has two second straps 145 and a second crown 155. The second watch face 135 has a second background pattern 150. In addition, the second watch 100 only has a minute hand 120 displaying the present minute time.

As indicated above, the first watch 10 may be an "hour hand only" watch that theoretically shows the present time. However, with only the hour hand, it is almost impossible to get a precise reading of the present time. The second watch 100 shows only the minute time. By combining the first watch 10 and second watch 100, the users may get a precise reading. Such a feature, as well as some other features, is shared by all the embodiments. In fact, a feature discussed for a particular embodiment should be considered included by the other embodiment as long as the feature does not conflict with the description of the other embodiment.

The background patterns 50 and 150 refer to the color, picture, shape, decoration, logo, and overall display on the watch faces 35 and 135, respectively. In FIGS. 1-5, the paired watches in a specific combination have the same background pattern. This is the preferred case, but not an exclusive requirement. It is also preferred that the background patterns are similar but not exactly the same. For example, while one watch may be bigger with a masculine appearance, the other may be smaller with a feminine appearance, though the overall background pattern is similar. The matching background patterns help to further demonstrate the mutual feelings between the wearers.

The background patterns 50 and 150, the style of the time marks 40 and 140, the straps 45 and 145, the style of the hour hand 20 and minute hand 120, as well as the style and design of the watch cases 15 and 115 and crowns 55 and 155, all combined, defines the overall design of the watches. In FIGS. 1-5, as a preferred format, the designs are the same between paired watches in the same combination. However, similar to the background patterns, having the same design is not a requirement. The designs may be matching with minor differences and individual appeals.

The analog watch format used in FIGS. 1A and 1B may or may not have the physical presence of the watch hands in a mechanical form. When the watches are mechanical, it is difficult to change the format of the watches. For example, a mechanical first watch 10 having an hour hand 20 may not be easily adjustable to become a watch that shows both an hour hand and a minute hand. The same is true for the second watch 100. In such context, the first watch 10 and the second watch 100 become almost indispensible to each other, making a strong showing or mutual affection and bond.

Alternatively, it is also possible that the watch hand displays are the result of electronic simulators present on a screen. Such technology is known to a person skilled in the art. The electronically simulated watch hands also allow higher level of flexibility. The first watch 10 and second watch 100 may be designed in such a manner that the display of watch hands may be controlled. For example, with a push of the crown 55, only an hour hand is displayed; with another push, only a minute hand is display; another push shows both hands; and yet another removes all hands, showing a blank watch face. Such a design allows the first watch 10 and second watch 100 to exchange roles as demonstrators of hour time an minute time. In addition, in certain circumstances, a user of a single watch may push a button to allow that watch to display the precise present time, making the timepiece combination more versatile and convenient.

Figure 2A:
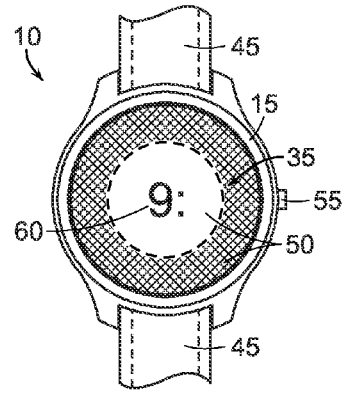
FIG. 2A and FIG. 2B show a front view of a timepiece combination having a first watch and a second watch in the digital display format.
Figure 2B:
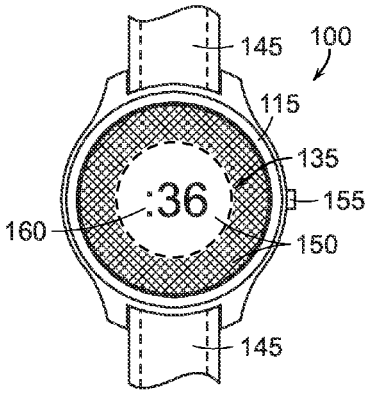

FIG. 2A and FIG. 2B show a front view of a timepiece combination having a first watch and a second watch in the digital display format. Shown in FIG. 2A is the first watch 10 having a first watch case 15 enclosing a first watch face 35. The first watch 10 also has two first straps 45 and a first crown 55. The first watch face 35 has a first background pattern 50. In addition, the first watch 10 only has an hour digit display 60 showing the hour number of a present time. Shown in FIG. 2B is the second watch 100 having a second watch case 115 enclosing a second watch face 135 having a set of second time marks 140 on the periphery of the second watch face 135. The second watch 100 also has two second straps 145 and a second crown 155. The second watch face 135 has a second background pattern 150. In addition, the second watch 100 only has a minute digit display 160 showing the minute number of the present time.

The embodiment shown in FIGS. 2A and 2B employs a digital format. However, just as the analog watches in FIGS. 1A and 1B, combining the first watch 10 and second watching 100 in FIGS. 2A and 2B also show a precise present time. With a digital display, the first watch only show the hour time. The adjustability described for the analog watches having simulated hands is just applicable to the second embodiment shown here.

Figure 3A:
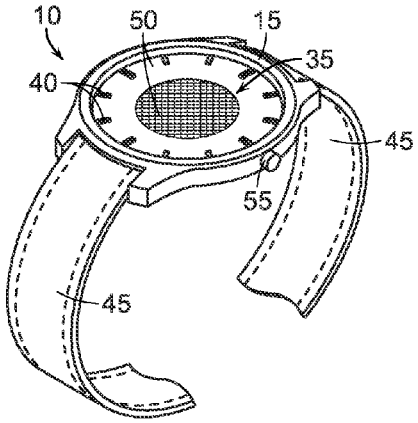
FIG. 3A and FIG. 3B show a front view of a timepiece combination having a first watch and a second watch with no time display mechanisms before being triggered.
Figure 3B:
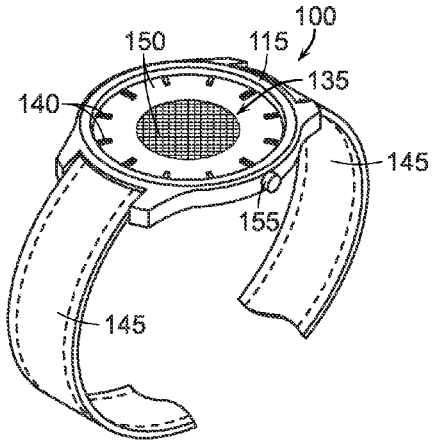

FIG. 3A and FIG. 3B show a front view of a timepiece combination having a first watch and a second watch with blank watch faces. Shown in FIG. 3A is the first watch 10 having a first watch case 15 enclosing a first watch face 35 having a set of first time marks 40 on the periphery of the first watch face 35. The first watch 10 also has two first straps 45 and a first crown 55. The first watch face 35 has a first background pattern 50. However, the first watch 10 does not have a time indicating mechanism, such as a watch hand or a digital display. Shown in FIG. 3B is the second watch 100 having a second watch case 115 enclosing a second watch face 135 having a set of second time marks 140 on the periphery of the second watch face 135. The second watch 100 also has two second straps 145 and a second crown 155. The second watch face 135 has a second background pattern 150. However, the second watch 100 does not have a time indicating mechanism, such as a watch hand or a digital display.

As described for the first and second embodiments, it is preferred that the time display mechanism is adjustable. And one possible stage of adjustable display is that the two watches appear blank. The time display may be triggered by different mechanism, including crown-pushing as indicated above. The time display may also be triggered by interactions of the first watch 10 and second watch 100. For example, when the first watch and second watch are in proximity to one another and the distance between them comes smaller than a threshold, e.g. 30 cm, 100 cm, 5 m, or 10 m, the display comes up. After triggering, the first watch 10 displays an hour time, either in analog or digital form, and the second watch 100 displays a minute time, also either in analog or digital form. Combining the hour time and the minute time provides a precise reading of the present time. With such a feature, the users may their mutual feeling not only through the timepiece combination, but also from their actions—putting the watches close to one another. It should also be noted that physical proximity is only one example of triggering the display and many other methods may serve the same purpose. For example, the watch display may be altered or initiated by tapping on the watch bodies. There may also be additional recognition mechanisms—such as a finger print reader—built into the watches to serve as triggering mechanism. The choices are limitless and one skilled in the art could recognize that various triggers mechanisms are encompassed by the spirit of the current invention.

Figure 4A:
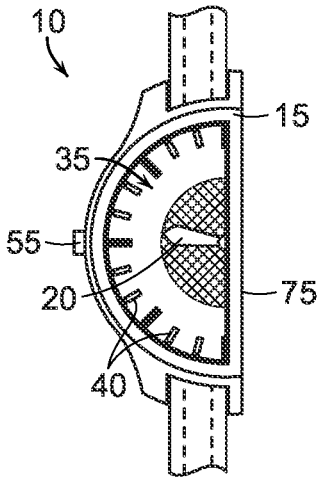
FIG. 4A and FIG. 4B show a front view of a timepiece combination having a first watch and a second watch with semicircular watch faces.
Figure 4B:
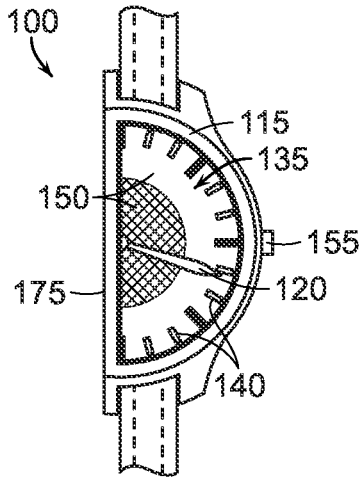

FIG. 4A and FIG. 4B show a front view of a timepiece combination having a first watch and a second watch with semicircular watch faces. Shown in FIG. 4A is the first watch 10 having a first watch case 15 enclosing a first watch face 35 having a set of first time marks 40 on the circular periphery of the first watch face 35. The first watch 10 also has two first straps 45, a first crown 55, and a first background pattern 50. In addition, the first watch 10 only has an hour hand 20 displaying a present time, particularly the hourly time of the present time. Shown in FIG. 4B is the second watch 100 having a second watch case 115 enclosing a second watch face 135 having a set of second time marks 140 on the circular periphery of the second watch face 135. The second watch 100 also has two second straps 145 and second crown 155. The second watch face 135 has a second background pattern 150. In addition, the second watch 100 only has a minute hand 120 displaying the present minute time. As shown in FIGS. 4A and 4B, the first watch 10 has a first even side 75 and the second watch 100 has a second even side 175.

The embodiment shown in FIGS. 4A and 4B share most of the features of the embodiments described above. Aside from the general design, this embodiment allows the first watch 10 and second watch 100 to have matching shapes. The first even side 75 may be held flush against the second even side 175, making the watches look like a whole when they are physically aligned to one another, further enhancing the function of the timepiece combination as a showpiece for the mutual feelings of the users.

Figure 5A:
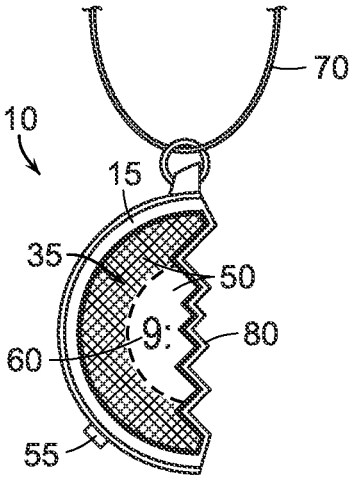
FIG. 5A and FIG. 5B show a front view of a timepiece combination having a first watch and a second watch with a generally semicircular watch faces having complimentary rugged sides.
Figure 5B:
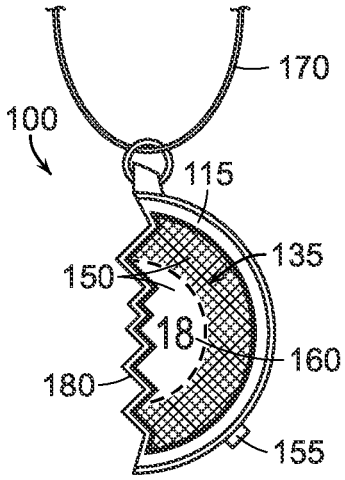

FIG. 5A and FIG. 5B show a front view of a timepiece combination having a first watch and a second watch with a generally semicircular watch faces having complimentary rugged sides. Shown in FIG. 5A is the first watch 10 having a first watch case 15 enclosing a first watch face 35. The first watch 10 also has a first crown 55 and a first necklace assembly 70, allowing the first watch 10 to be worn on a person's neck or be used as a pocket watch. The first watch face 35 has a first background pattern 50. In addition, the first watch 10 only has an hour digit display 60 showing the hour number of a present time. Shown in FIG. 5B is the second watch 100 having a second watch case 115 enclosing a second watch face 135. The second watch 100 also a second crown 155 and a second necklace assembly 170, allowing the second watch 100 to be worn on a person's neck or be used as a pocket watch. The second watch face 135 has a second background pattern 150. In addition, the second watch 100 only has a minute digit display 160 showing the minute number of the present time. As shown in FIGS. 5A and 5B, the first watch 10 has a first rugged side 80 and the second watch 100 has a second rugged side 180.

The fifth embodiment shown in FIGS. 5A and 5B are somewhat similar to the one shown in FIGS. 4A and 4B, while the current embodiment has a rugged side. The idea is still that the first watch 10 and second watch 100 may be aligned together to be combined and show the precise present time. The first rugged side 80 are second rugged side 180 are complimentary and the sides may be held flush to each other, showing a sense of unity, among other things. The embodiment shown in FIGS. 5A and 5B is a set of pocket or necklace watches, instead of straps shown in other embodiments. The combined watch faces may also be a heart shape or any other shapes, instead of being round.

Preferably, the timepiece combination has two timepieces. However, it is possible that the timepiece combination has more than two timepieces and the display may adjustable. For example, a timepiece combination may have a first, a second, and a third watch. While these watches are blank without triggering, the closeness of any two watches may prompt one watch to show the hour time and the other to show the minute time. The closeness of all three watch may trigger one to show hour time, the second to show minute, and the third to show second time. With such a design, the three-watch combination may serve similar purposes as the two-watch combinations, with a further layer of complexity and alternatives.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A timepiece combination, comprising:

a first timepiece having two first straps with each strap being connected to a first watch case of the first timepiece, wherein the first timepiece shows an hour time of a present time;

and a second time piece having two second straps with each strap being connected to a second watch case of the second timepiece, wherein the second timepiece shows only a minute time of the present time;

wherein the first time piece is worn by a first person and the second timepiece is worn by a second person, and wherein combining the reading of the first timepiece and second timepiece displays a precise reading of the present time.

2. The timepiece combination of claim 1, wherein the first time piece is a first watch having a first watch case enclosing a first watch face having a set of first time marks on a periphery of the first watch face, wherein the first watch only has an hour hand displaying the present time, and the second time piece is a second watch having a second watch case enclosing a second watch face having a set of second time marks on the periphery of the second watch face, wherein the second watch only has a minute hand displaying the minute time of the present time.

3. The timepiece combination of claim 2, wherein the first watch face has a first background pattern, the second watch face has a second background pattern, and the first background pattern is the same as the second background pattern.

4. The timepiece combination of claim 2, wherein the first watch further comprises two first straps and a first crown located outside the first watch case, and the second watch further comprises two second straps and a second crown located outside the second watch case.

5. The timepiece combination of claim 4, wherein the first watch has a first watch design, the second watch has a second watch design, and the first watch design is the same as the second watch design.

6. The timepiece combination of claim 4, wherein the first watch has a first watch design, the second watch has a second watch design, and the first watch design is complimentary to the second watch design.

7. The timepiece combination of claim 2, wherein the first watch and the second watch are mechanically powered.

8. The timepiece combination of claim 2, wherein the first watch and the second watch are electrical watches, and the hour hand and the minute hand are electrically displayed simulator hands.

9. The timepiece combination of claim 1, wherein the first time piece is a first watch having a first watch case enclosing a first watch face, wherein the first watch face shows only an hour digit displaying the hourly time of a present time, and the second time piece is a second watch having a second watch case enclosing a second watch face, wherein the second watch face shows only a minute digit displaying the minute time of the present time.

10. The timepiece combination of claim 9, wherein the first watch face has a first background pattern, the second watch face has a second background pattern, and the first background pattern is the same as the second background pattern.

11. The timepiece combination of claim 2, wherein the first watch face has a semicircular shape having a first even side, the second watch face has a semicircular shape having a second even side, and the first even side is capable of being held flush with the second even side to display the precise present time.

12. The timepiece combination of claim 11, wherein
the first watch and the second watch are electrical watches,
and the hour hand and the minute hand are electrically displayed simulator hands.

13. The timepiece combination of claim 9, wherein
the first watch face has a semicircular shape having a first even side,
the second watch face has a semicircular shape having a second even side, and the first even side is capable of being held flush with the second even side to display the precise present time.

14. The timepiece combination of claim 13, wherein
the first watch face has a first background pattern,
the second watch face has a second background pattern,
and the first background pattern is the same as the second background pattern.

15. The timepiece combination of claim 9, wherein
the first watch face has a semicircular shape having a first rugged side,
the second watch face has a semicircular shape having a second rugged side, and the first rugged side is capable of being held complementary to and flush with the second rugged side to display the precise present time.

16. A timepiece combination comprising:
a first watch having two first straps, a first watch case enclosing a first watch face having a set of first time marks on a periphery of the first watch face, and a first background pattern,
wherein each of the two first straps are connected to the first watch case; and
a second watch having two second straps, a second watch case enclosing a second watch face having a set of second time marks on the periphery of the second watch face, and a second background pattern, the second background pattern being same as the first background pattern,
wherein each of the two second straps are connected to the second watch case;
wherein time indication mechanisms of the first watch and the second watch require activation and wherein after the activation the first watch displays a reading of an hourly time of present time and the second watch displays a minute reading of the present time,
wherein the first timepiece is worn by a first person and the second timepiece is worn by a second person, and
wherein combining the readings of the first and the second watch displays a precise reading of the present time.

17. The timepiece combination of claim 16, wherein
the time indicating mechanisms of the first watch and the second watch are activated when the first watch is in proximity of the second watch.

18. A timepiece combination, comprising:
a first watch having two first straps and a first watch case enclosing a first watch face having a set of first time marks on a periphery of the first watch face, wherein
the first watch only has an hour hand displaying an hour reading of the present time,
each of the two first straps are connected to the first watch case,
and the first watch face has a first background pattern,
and a second watch having two second straps and a second watch case enclosing a second watch face having a set of second time marks on the periphery of the second watch face, wherein
the second watch face has a second background pattern,
the second watch only has a minute hand displaying a minute reading of the present time,
each of the two second straps are connected to the second watch case, the first background pattern is the same as the second background pattern,
combining the hour reading and minute reading of the first timepiece and second timepiece displays a precise reading of the present time, and
wherein the first timepiece is worn by a first person and the second timepiece is worn by a second person.

19. A timepiece combination, comprising
a first watch having two first straps and a first watch case enclosing a first watch face, wherein
on the first watch face shows only an hour digit displaying an hour time of a present time,
each of the two first straps are connected to the first watch case,
and the first watch face has a first background pattern,
and a second watch having two second straps and a second watch case enclosing a second watch face, wherein
on the second watch face shows only a minute digit displaying a minute time of the present time,
each of the two second straps are connected to the second watch case,
the second watch face has a second background pattern,
the first background pattern is the same as the second background pattern,
and combining the first timepiece and second timepiece displays a precise reading of the present time, and
wherein the first timepiece is worn by a first person and the second timepiece is worn by a second person.

* * * * *